United States Patent [19]

Collins

[11] 4,208,931

[45] Jun. 24, 1980

[54] METHOD AND APPARATUS FOR CUTTING BLOCKS OF BULK MATERIAL

[75] Inventor: Truman F. Collins, Springfield, Mo.

[73] Assignee: Kraft, Inc., Glenview, Ill.

[21] Appl. No.: 945,418

[22] Filed: Sep. 25, 1978

[51] Int. Cl.[2] ..... B26D 1/02

[52] U.S. Cl. ..... 83/44; 83/408; 83/422; 83/424; 83/425.3; 83/651.1; 83/926 H

[58] Field of Search ..... 83/44, 408, 422, 425.2, 83/425.3, 651.1, 926 H, 424, 171

[56] References Cited

U.S. PATENT DOCUMENTS

| | | | |
|---|---|---|---|
| 2,282,546 | 5/1942 | Schwimmer | 83/171 X |
| 3,059,306 | 10/1962 | Hamilton | 83/425.3 X |
| 3,064,111 | 11/1962 | Newman | 83/171 X |
| 3,108,350 | 10/1963 | Bergling | 83/651.1 X |
| 3,492,703 | 2/1970 | Bergling et al. | 83/651.1 X |
| 3,499,355 | 3/1970 | Wiatt et al. | 83/424 X |
| 3,803,959 | 4/1974 | Rung | 83/424 X |

*Primary Examiner*—Frank T. Yost

*Attorney, Agent, or Firm*—Fitch, Even & Tabin

[57] ABSTRACT

A method and apparatus for cutting blocks of bulk material such as cheese and the like into slabs and bars wherein an elongate cutter filament is supported by and between supply and take-up spools so as to extend transversely of a slab cutting station adapted to receive a block of bulk material therein. The supply and take-up spools are operable to move the cutter filament through the block to sequentially cut slabs therefrom and to incrementally advance the cutter filament after each cut so as to remove any given segment of the cutter filament from the effective cutting length before it fatigues to possible failure. After cutting slabs from the block, the slabs are passed through a bar cutter die operative to cut the slab into a plurality of bars of substantially uniform size and weight.

34 Claims, 12 Drawing Figures

5.
6.
7.
26
100
102
104
106
108
110
112
116
118
120
122
126
128
130
132
134a
134b
136a
138b
140a
150a
150b
156
156a
156b
158
160
164
164a
166
170
172
176
178
180
182
182a
186
188
190
192
194a
194b
196a
196b
216
20

METHOD AND APPARATUS FOR CUTTING BLOCKS OF BULK MATERIAL

The present invention relates generally to slicing or cutting of blocks of bulk material, and more particularly to a novel method and apparatus for cutting blocks of bulk material into slabs and bars.

It is a common practice in the manufacture of many products, such as in the manufacture of cheese and the like, to produce relatively large blocks of bulk material which are subsequently cut or sliced into smaller size blocks, slabs or bars of desirably uniform size and weight and which facilitate further processing or slicing into more readily marketable sizes. For example, natural cheese is commonly manufactured in bulk blocks of generally rectangular shape weighing in excess of 640 pounds and measuring in excess of about two feet along each dimension. In order to form smaller size portions which are manageable for further processing or for consumer distribution, each bulk block is conventionally cut transversely into slabs only a few inches thick. Each slab is then further cut or sliced into a plurality of elongate bars which may then be subjected to further processing or cut into consumer size portions. In either case, it is desirable that the slabs and bars be as uniform in weight and size as possible.

One generally known technique for cutting blocks of bulk material such as cheese into smaller size slabs is to pass a cutting element, such as an elongate wire filament, through the block while maintaining the cutting filament generally transverse to the block as it is passed therethrough in a direction normal to the cutting filament. This technique has proven particularly satisfactory in cutting bulk blocks of cheese because the elongate filament produces a minimal amount of friction as it passes transversely through the cheese block.

In an effort to obtain accurate and uniform thickness between successive cut slabs when employing a transverse elongate cutting filament to cut blocks of bulk cheese, the elongate cutting filaments are generally maintained under tensile stress so that they will remain relatively taut and as linear as possible as they pass through the cheese. As a cutting wire filament is passed transversely through a block of bulk material such as cheese, the filament undergoes increased tensile loading due to the resistance of the material being cut. After repeated cutting operations, the cutting filaments may undergo elongation and eventually fatigue to a point of failure, thus requiring replacement with attendant apparatus shut down and production losses. Such fatigue failure of cutting filaments has been found particularly prevelant where the cutting lengths of the filaments are substantial, such as approximately two feet or longer in length.

After a block of bulk cheese has been cut transversely thereof to form slabs of substantially uniform thickness as aforedescribed, it is frequently desirable that the slabs then be further cut into smaller size bars of uniform size and weight. Conventionally, the slabs have been cut into bars by sequentially pushing the cut slabs from a rear or back end surface thereof through a gang slicer comprising a plurality of parallel equidistantly spaced wire cutter filaments disposed transverse to the direction in which the slab is pushed. A significant drawback in forming bars from slabs by this technique is that as a slab is pushed from behind through the multi-wire cutter die, the slab tends to balloon and distort somewhat so that irregular cut lines result from the cutter wire filaments. This leads to bars having nonuniform shapes and weights.

One of the primary objects of the present invention is to provide a novel method and apparatus for cutting a block of bulk material, such as cheese and the like, into slabs and bars.

A more particular object of the present invention is to provide a method and apparatus for sequentially cutting a block of bulk material into slabs of of substantially uniform size wherein an elongate cutter filament is supported transversely of the block and is caused to pass through the block in a direction transverse to the cutting length of the cutter filament, the cutter filament being incrementally advanced after each successive cut so as to remove any given segment of the cutting filament from the effective cutting length before it fatigues to a point of failure.

Still another object of the present invention is to provide a method and apparatus for cutting a slab of cheese and the like into bars of substantially uniform size and weight, wherein the slab is grasp between movable feed belts and compression rollers closely adjacent a multi-wire cutter die so as to force the slab through the cutter die while applying minimum pressure over a relatively large area of the slab, whereby to minimize distortion of the slab as it passes through the cutter die.

A feature of the apparatus of the invention lies in the provision of supply and take-up spools mounted on movable carriages disposed on opposite sides of a slab cutting station and having an elongate cutter wire filament supported therebetween transversibly of a block of material within the slab cutting station, and including means operatively associated with the supply and take-up spools to effect incremental advance of the cutter filament from the supply to the take-up spool after each cut while maintaining the filament under predetermined axial tension during cutting.

Further objects and advantages of the present invention, together with the organization and manner of operation thereof, will become apparent from the following detailed description of the invention when taken in conjunction with the accompanying drawings wherein like reference numerals designate like elements throughout the several views, and wherein.

Figure 1:
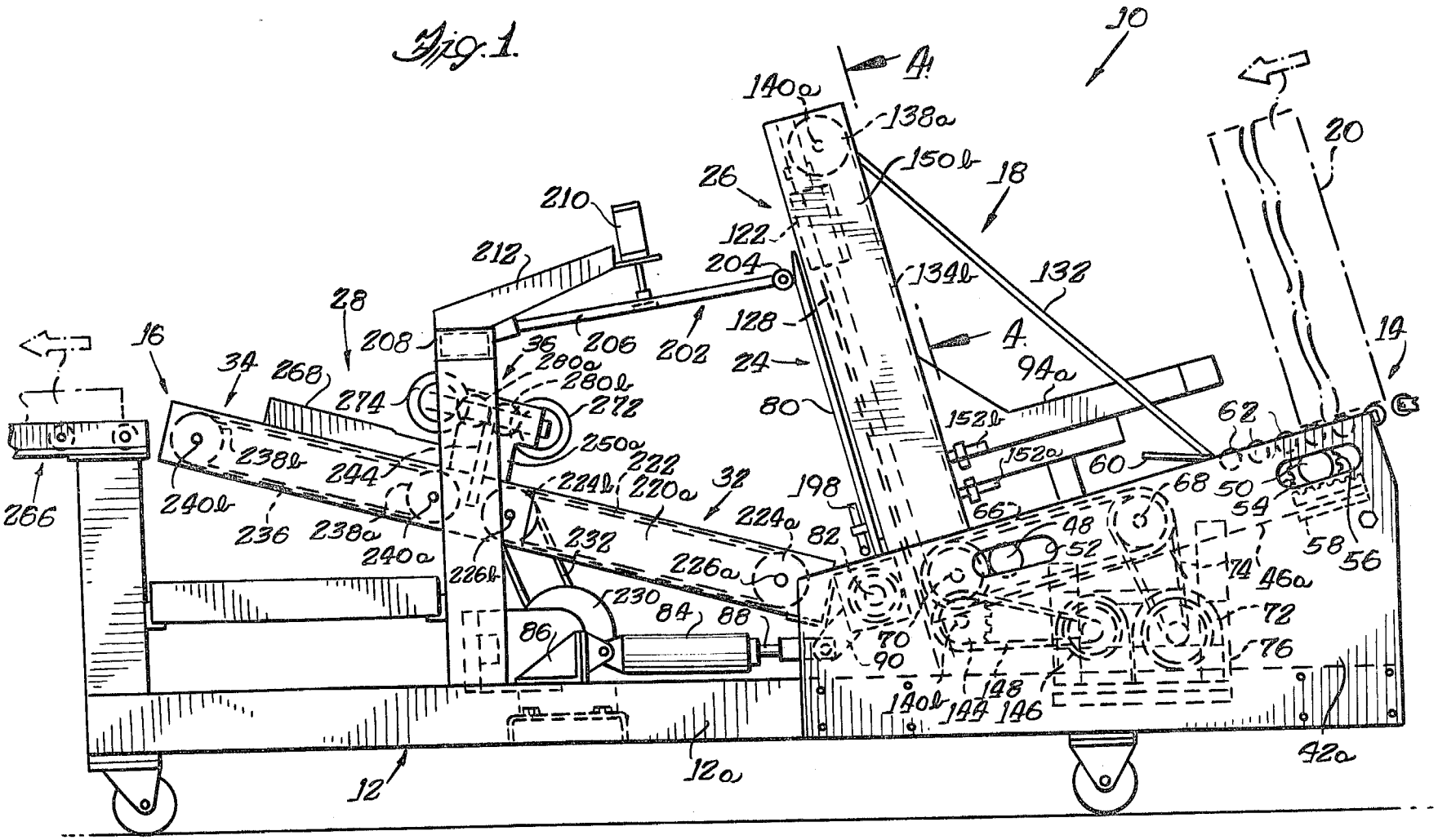
FIG. 1 is a side elevational view of an apparatus embodying various of the features of the present invention.
Figure 2:
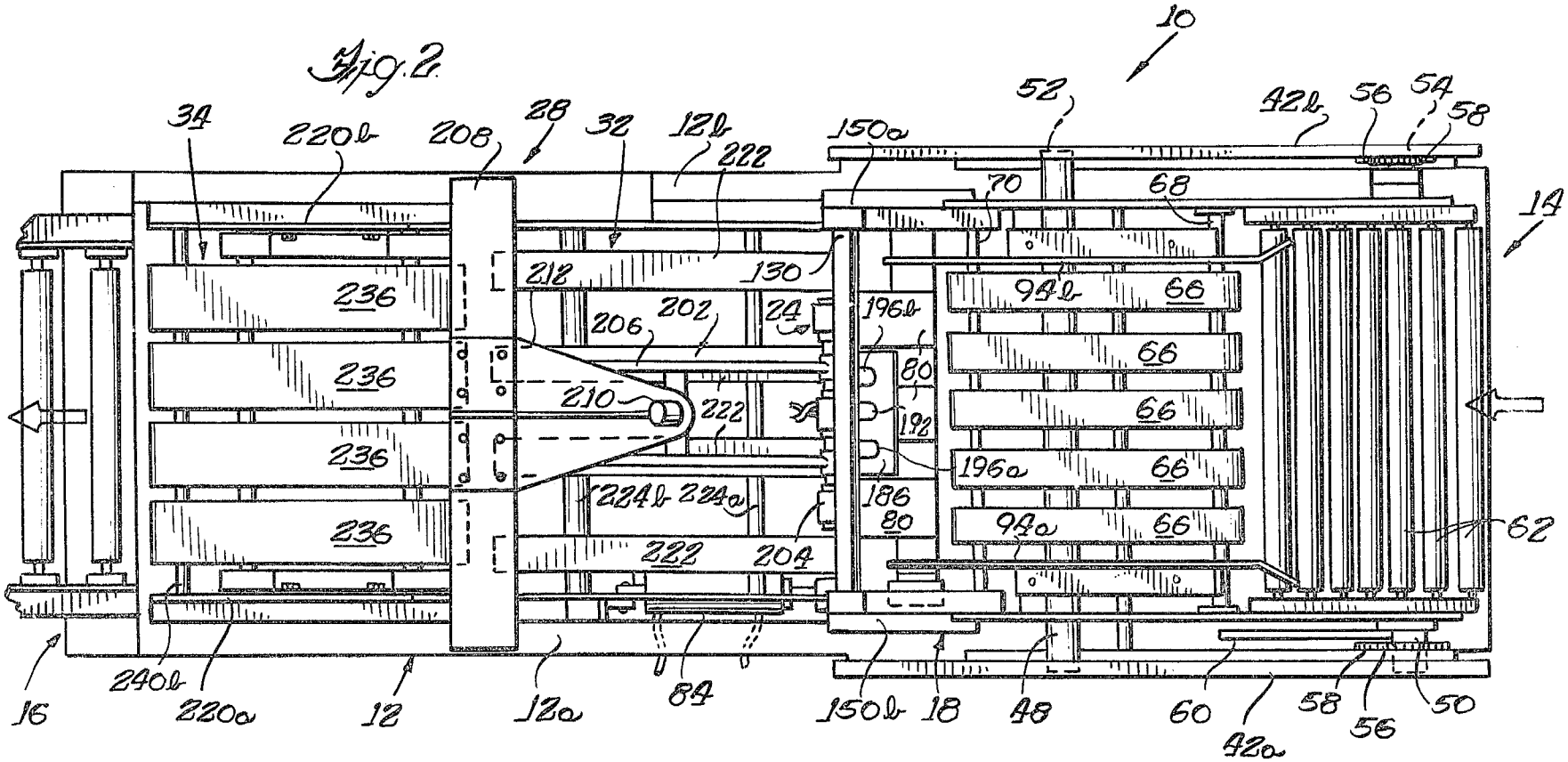
FIG. 2 is a plan view of the apparatus shown in FIG. 1.
Figure 3:
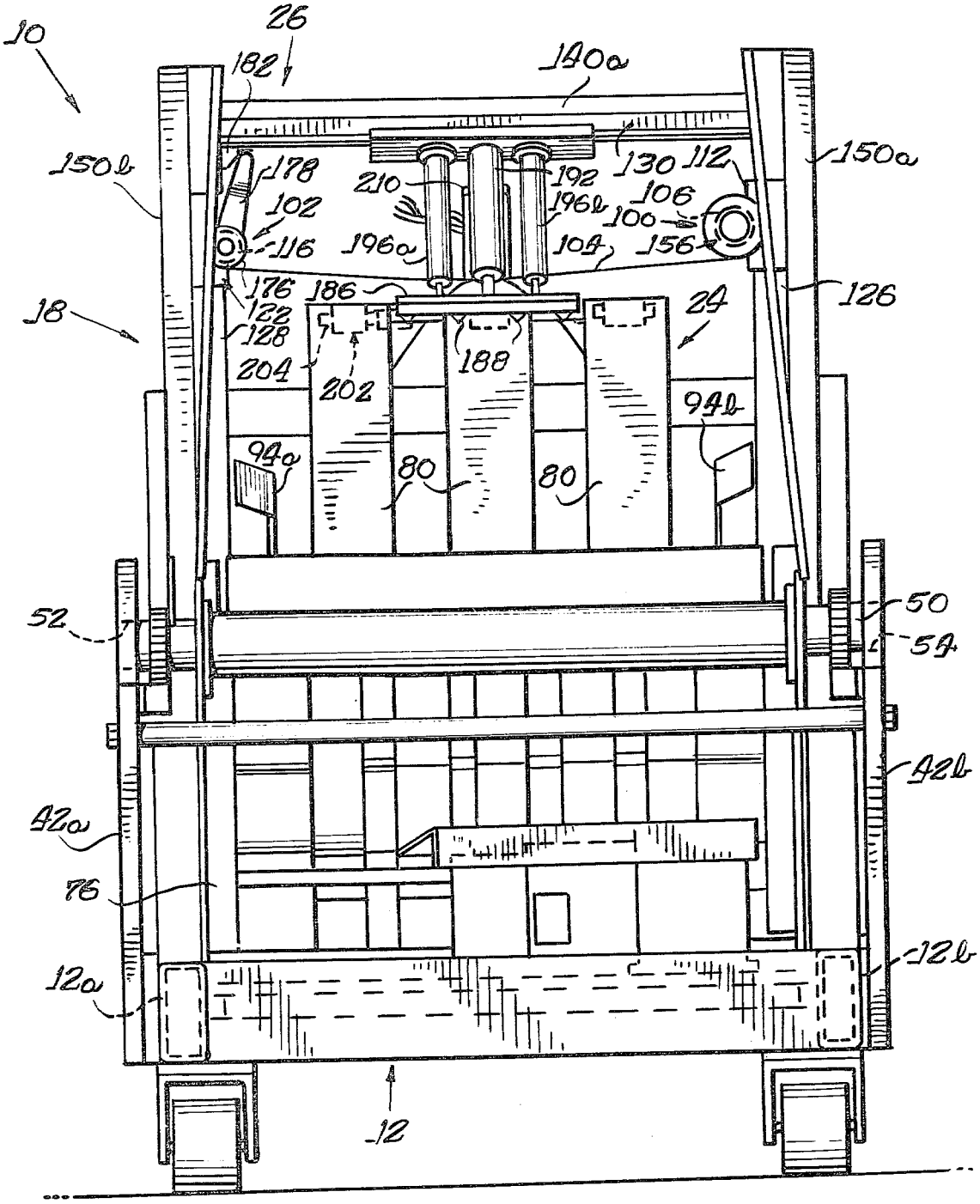
FIG. 3 is an elevational view, on a slightly larger scale, of the in-feed end of the apparatus shown in FIG. 1.

Referring now to the drawings, and in particular to FIGS. 1-3, apparatus for cutting a block of bulk material into slabs and bars and incorporating various features of the present invention is indicated generally at 10. The apparatus 10 finds particular application in sequentially cutting relatively large blocks of bulk cheese and the like into slabs of substantially uniform thickness, and thereafter cutting each slab into a plurality of bars of substantially uniform size and weight.

Very generally, the apparatus 10, which may alternatively be termed a slabber and bar cutting machine, includes a main frame 12 having an entry or in-feed end 14 and an exit or discharge end 16. A slab cutting station, indicated generally at 18, is supported on the main frame 12 and is adapted to receive a block of bulk material, such as illustrated in phantom at 20 in FIG. 1, within the cutting station preparatory to cutting transverse slabs from the block of bulk material. Stop means, indicated generally at 24, in the form of a plurality of arm members, are mounted on the frame 12 for cooperative relation with the slab cutting station 18 and assist in positioning a block of bulk material is predetermined relation to the slab cutting station. The slab cutting station 18 includes slab cutter means, indicated generally at 26, adapted to sequentially cut slabs of predetermined thickness from a block 20 of bulk material disposed within the cutting station.

After cutting a slab from the block of bulk material, the slab is lowered by arm members of the stop meams 24 to a bar cutting station, indicated generally at 28, which includes bar cutter in-feed means 32, bar cutter out-feed means 34, and bar cutter die means 36 disposed intermediate the in-feed and out-feed means and operative to cut a slab into a plurality of substantially uniform size and weight bars as the slab is moved through the die cutter means.

As will be explained in greater detail hereinbelow, the slab cutter means 26 includes an elongate cutter filament which is supported so as to define a reach of cutter filament disposed transversely to the slab cutting station and is movable in a direction transverse to a block of material disposed within the slab cutting station so as to facilitate sequential cutting of the block of bulk material into stabs which are successively lowered to the cutter in-feed means 32 and moved through the bar cutter die means 36 during which the slabs are cut into bars of uniform size and weight. After each pass of the elongate cutter filament through the block of bulk material to cut a slab therefrom, the cutter filament is longitudinally advanced so as to progressively move any given segment of the cutter wire filament from the effective cutting length of the filament before it fatigues and possibly fails under tensile loading as has heretofore been experienced in prior slabbing apparatus.

The block 20 of bulk material for which the apparatus 10 is particularly adapted may comprise a block of bulk cheese having a weight of approximately 640 pounds and a generally rectangular configuration measuring approximately 2 feet or more along each dimension.

Turning now to a more detailed description of the apparatus 10, the main frame 12 includes a pair of longitudinal frame members 12*a* and 12*b* maintained in parallel spaced relation by suitable cross members. Frame side plates 42*a* and 42*b* are mounted in parallel upstanding relation on the frame member 12*a* and 12*b*, respectively, and serve to support the slab cutter station 18 therebetween.

The slab cutting station 18 includes a pair of side frame members 46*a* and 46*b* which are mounted on and maintained in parallel spaced relation by front and rear support shafts 48 and 50, respectively. The opposite ends of the support shafts 48 and 50 are received, respectively, within laterally aligned pairs of elongated slots 52 and 54 formed in the frame plates 42*a,b* so as to support the slab cutting station 18 between the frame plates while allowing adjustment thereof relative to the main frame, and thus the stop means 24, in the direction of the major axes of the elongated slots 52, 54.

To maintain the cutter station in selected predetermined position relative to the main frame 12, the rear support shaft 50 has a pinion gear 56 secured on each of the opposite ends thereof for cooperation with associated racks 58 secured to the opposing inner sufaces of the frame plates 42*a,b*. An actuating lever 60 is mounted on the support shaft 50 and facilitates rotation of shaft 50 so as to move the slab cutting station 18 relative to the main frame 12. Suitable means (not shown) are preferably provided to retain the actuating lever 60 in a desired adjusted position.

The laterally spaced frame members 46*a,b* of the cutter station have a plurality of coplanar parallel spaced conveyor in-feed rollers 62 journalled therebetween which serve to receive a block, such as block 20, of bulk material from a transfer conveyor or other suitable means which may be positioned in alignment with the in-feed end 14 at an elevation sufficient to enable the block to pass onto the in-feed rollers 62.

The side frame members 46*a,b* of the slab cutting station 18 also support a plurality of endless table top chains or belts 66 of known design on pairs of sprockets fixed to and carried by parallel transverse shafts 68 and 70 suitably journalled to and between the side frame members 46*a,b* so that upper runs of the table top chains are substantially coplanar with a plane containing the uppermost elements of the conveyor rollers 62. One of the sprocket support shafts, such as 68, is connected to a suitable electric drive motor 72 through a chain and sprocket drive 74 to facilitate in-feeding movement of the table top chains 66. The motor 72 is mounted on a support frame 76 suspended below the frame members 46*a,b*.

As best seen in FIG. 1, the side frame members 46*a,b* are inclined relative to horizontal, preferably at an angle of approximately 15°. so that a block 20 of bulk material fed onto the conveyer rollers 62 will move downwardly on the roller bed to the table top chains 66 which are operative to power the block of bulk material into a slabbing position. The slabbing position is established by the stop means 24 which, in the illustrated embodiment, comprises a plurality of arm members 80 secured at their lower ends to a pivot shaft 82 rotatably supported by and between the upstanding side plates 42*a,b* in transverse relation thereto. In the illustrated embodiment, three parallel coplanar arm members 80 are mounted on the pivot shaft 82 for pivotal movement between upstanding positions disposed substantially perpendicular to the plane of the upper runs of the table top chains 66, and lower positions wherein the arm members are disposed below the upper plane of the bar cutter infeed means 32, as will be described in greater detail hereinbelow. To effect such pivotal movement of the arm members 80, a fluid pressure actuating cylinder 84, preferably pneumatically operated, is pivotally mounted on the base frame 12 through a bracket 86 and has its extendible piston rod 88 pivotally connected to an actuating arm 90 fixed radially to the pivot shaft 82.

Because the arm members 80 are mounted on the side plates 46*a,b* independently of the slab cutting station 18 which, as aforenoted, is longitudinally adjustable relative to the side plates 42*a,b* it will be appreciated that selective adjustment may be made between the slab cutting station and the stop means defined by the arm members 80 so as to selectively vary the thickness of slabs to be cut from a block of bulk material. As will become more apparent hereinbelow, the stop arms 80 also serve as slab transfer arms to transfer a cut slab to the bar cutter infeed means 32 preparatory to cutting the slab into uniform bars.

A pair of laterally spaced infeed guides 94*a* and 94*b* are mounted on the side frame members 46*a,b* of the slab cutting station 18 and are positioned to frictionally engage a block 20 as it is advanced by the table top chains 66. The guides 94*a,b* maintain the block in generally transversely centered relation on the slab cutting station and also restrain unintentional movement of the block when the arm members 80 are pivoted to their downward positions.

As aforenoted, the slab cutting station 18 includes slab cutter means 26 for sequentially cutting slabs of predetermined thickness from a block of bulk material disposed within the cutting station with its forward surface disposed against the stop arm members 80. With particular reference to FIGS. 4–7, taken in conjunction with FIGS. 1–3, the slab cutter means 26 includes filament supply means 100 mounted on one side of the slab cutting station 18 adjacent the forward end thereof and adapted to support a length of an elongate cutter filament, filament take-up means 102 mounted on the laterally opposite side of the slab cutting station 18 adjacent the forward end thereof and adapted to take up the elongate filament from the filament supply means 100, and a substantially non-elastic elongate filament 104 supported by the filament supply and take-up means so as to define a reach or run of the elongate filament disposed between the supply and take-up means transverse to a block of bulk material disposed within the slab cutting station 18 preparatory to cutting slabs therefrom.

Figure 6:
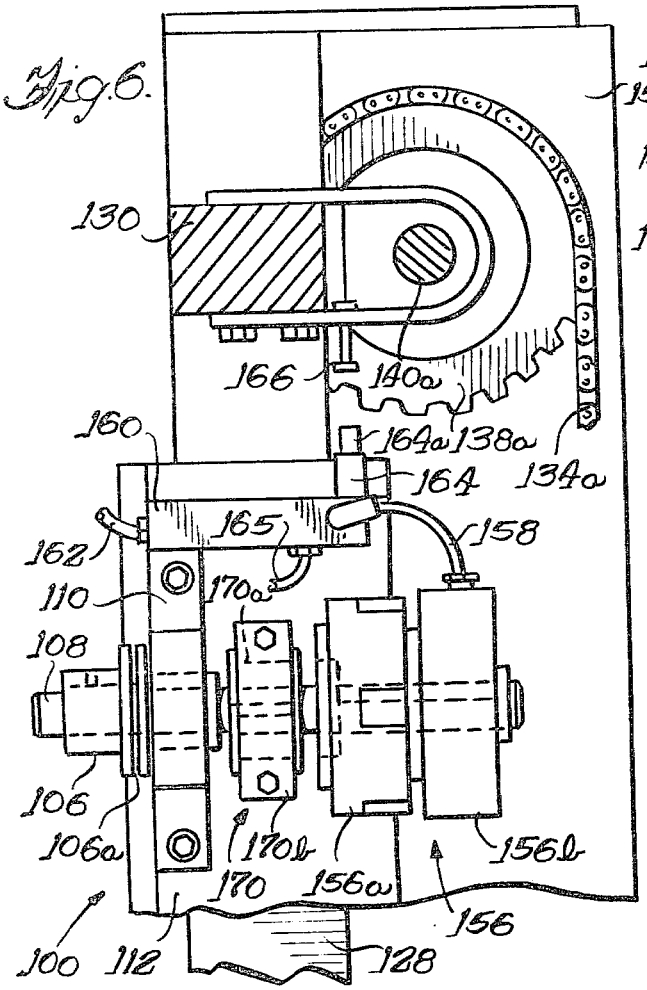
FIG. 6 is a fragmentary sectional view taken substantially along line 6—6 of FIG. 4, looking in the direction of the arrows.

The filament supply means 100 includes a supply spool 106 fixed on a support shaft 108 which is journalled within a spool support block 110 mounted on and carried by a carriage 112, as best seen in FIG. 6. The filament take-up means 102 includes a similar spool 116 fixed on a support shaft 118 which is journalled within a spool support block 120 mounted on a carriage 122, as best in FIG. 7. The spools 106 and 116 are of known design and have annular grooves 106*a* and 116*a*, respectively, formed therein adapted to receive the elongate cutter filament 104 in wound relation thereon. The cutter filament 104 comprises a suitable elongate non-elastic filament such as 0.051 diameter high tensile strength music wire.

The carriages 112 and 122 are mounted on and slidingly movable along guide posts 126 and 128, respectively, which are mounted at their lower ends to the forward ends of the side frame members 46*a,b*, respectively, of the slab cutting station 18 so as to extend upwardly in normal relation to the side frame members on laterally opposite sides of the slab cutting station, as best seen in FIGS. 1 and 3. The guide posts 126 and 128 are interconnected at their upper ends through a transverse cross bar 130. Laterally spaced struts 132 are preferably secured at their opposite ends to the outer ends of the cross bar 130 and the side frame members 46*a,b* for stability purposes.

In cutting slabs from a block 20 of bulk material disposed within the slab cutting station 18, the carriages 112 and 120 are moved from upper positions on their respective guide posts 126 and 128 downwardly thereon so as to pass the elongate cutter filament 104 through the bulk material in a direction substantially transverse to the extending reach of the filament disposed between the supply and take-up spools 106 and 116, respectively. Following each pass of the cutter filament, the carriages are returned or indexed back to their upper positions preparatory to the next slabbing cut. To effect synchronized and corresponding movements of the carriages 112 and 122, the carriages are connected to the opposite ends of drive chains 134*a* and 134*b*, respectively, each of which is reaved about upper and lower pairs of vertically aligned sprockets 136*a,b* and 138*a,b* mounted on the opposite ends of transverse upper and lower support shafts 140*a,b* suitably journalled to the upper and lower ends of the guide posts 126 and 128.

The lower sprocket support shaft 140*b* has a drive sprocket 144 secured thereon which is connected to a suitable reversible electric indexing drive motor 146 through a drive chain 148. In this manner, selective energizing of the drive motor 146 is operative to effect synchronized upward and downward movement of the carriages 112 and 122 during a slab cutting operation.

Figures 4, 5:
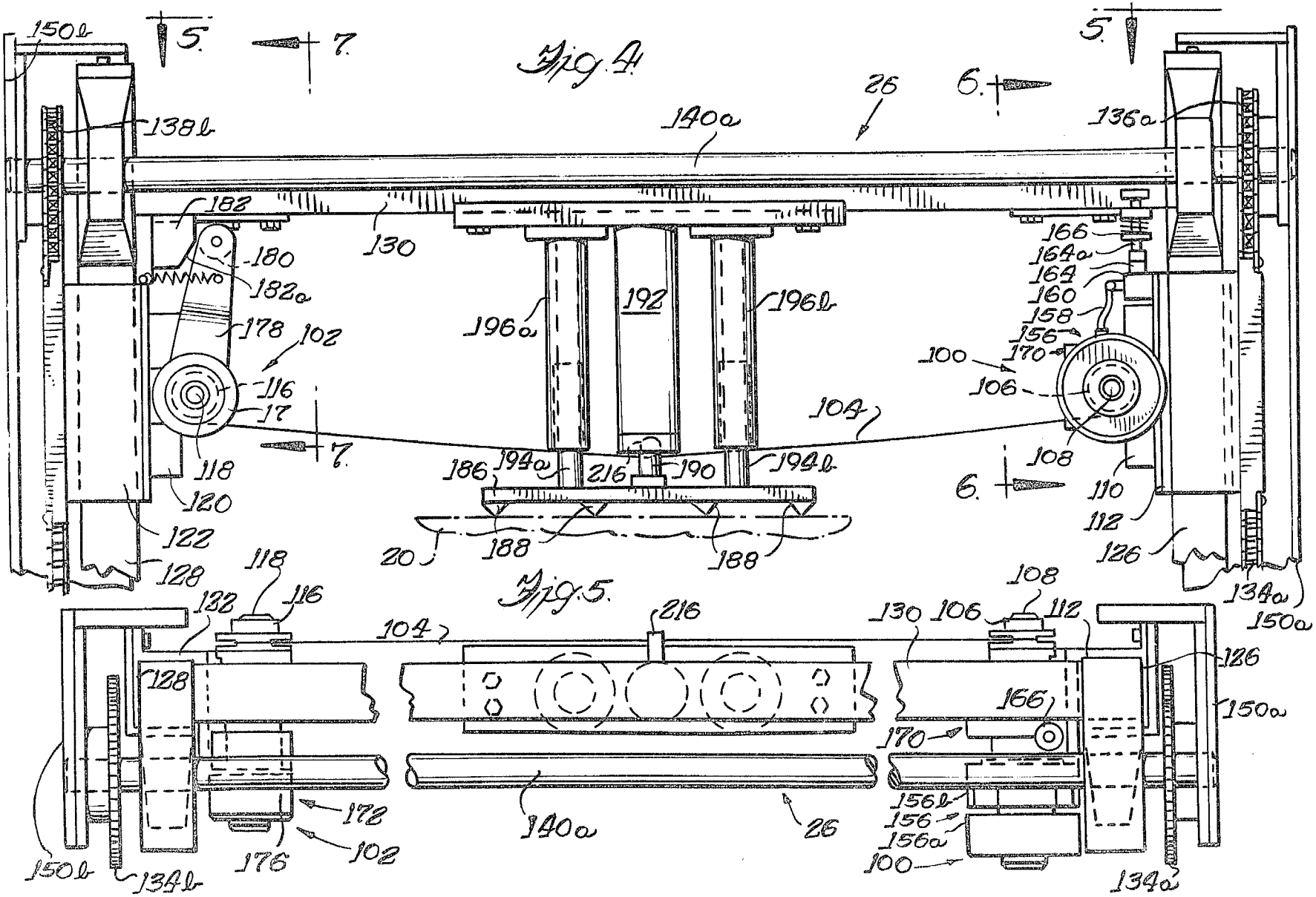
FIG. 4 is a fragmentary transverse sectional view taken along line 4—4 of FIG. 1, looking in the direction of the arrows.
FIG. 5 is a fragmentary plan view of the slab cutting station, taken substantially along line 5—5 of FIG. 4 and looking in the direction of the arrows.

Shield or chain guide plates 150*a,b* are mounted outwardly of each of the carriage drive chains 134*a,b* and their associated sprockets and guide posts 126 and 128, as best seen in FIGS. 1, 4 and 5. A pair of proximity or limit switches 152 *a,b* (FIG. 1) of known design are mounted on the shield plate 150*a* for cooperation with actuators (not shown) carried by the carriage indexing drive chain 134*b*. The switches 152*a,b* are cooperative with the control circuit (not shown) for the carriage drive motor 146 to effect selective reversal thereof so as to effect reciprocating movement of the carriages 112, 122 and cutter wire filament 104 carried therebetween during a slabbing operation.

As aforementioned, a problem frequently experienced with prior art apparatus adapted to cut a block of bulk material into smaller size slabs by passing a transversely disposed elongate cutter filament through the block is that the cutter filament tends to fatigue and fail during use over a relatively short period of time. In accordance with an important feature of the present invention, the filament supply means 100 and filament take-up means 102 are adapted to incrementally advance the elongate cutter filament 104 between the supply and take-up spools 106 and 116, respectively, after each pass of the cutter filament through the block 20 of bulk material in cutting slabs therefrom. In this manner, any given segment of the cutter filament is progressively removed from the effective cutting length of the cutter filament before it fatigues to a point of failure.

With particular reference to FIG. 6, taken in conjunction with FIGS. 4 and 5, the end of the supply spool support shaft 108 opposite the spool 106 has an air brake or clutch assembly 156 of known design mounted coaxially thereon which includes a breaking disc portion 156*a* and a pneumatically expandable chamber portion 156*b*. The expandable chamber portion 156*b* is connected to a suitable source of air pressure (not shown) through a pressure line 158 connected to a manifold block 160 which is mounted on the carriage 112 and has connection to the source of air pressure through a pressure line 162. The manifold block 160 supports an air release valve 164 in communication with the air pressure passage to the air brake 156 so that depression of an upwardly biased actuator 164*a* on the air release valve serves to release air pressure from the air brake, as through a flow line 165 open to atmosphere. An adjustable stop 166 is suitably supported on the crossbar 130 in axial overlying relation to the actuator 164*a* of the air release valve 164 so as to be engaged by the actuator 164*a* each time the carriage 112 and associated supply spool 106 reach their uppermost position on the guide post 126.

To prevent free rotation of the supply spool 106 when air pressure is released from the air brake 156, a friction brake 170 of conventional design is mounted coaxially on shaft 108. The friction brake 170 has an inner annular bushing 170*a* which is fixed on the shaft 108 and is frictionally rotatable within an outer preload clamp portion 170*b* secured to the carriage 112 and adjustable to selectively vary the frictional relation with the bushing 170*a*. In this manner, release of air pressure from the air brake 156 releases the shaft 108 and associated supply spool 106 for rotation against the restraining force of the friction brake 170 to allow feeding of the cutter filament 104 from the supply spool. It will be appreciated that at all times other than when the carriage 112 is at its upper limit of travel on the guide post 126, air pressure supply to the air brake 156 prevents rotation of the supply spool 106 so as to prevent let-off of the cutter wire filament.

Figure 7:
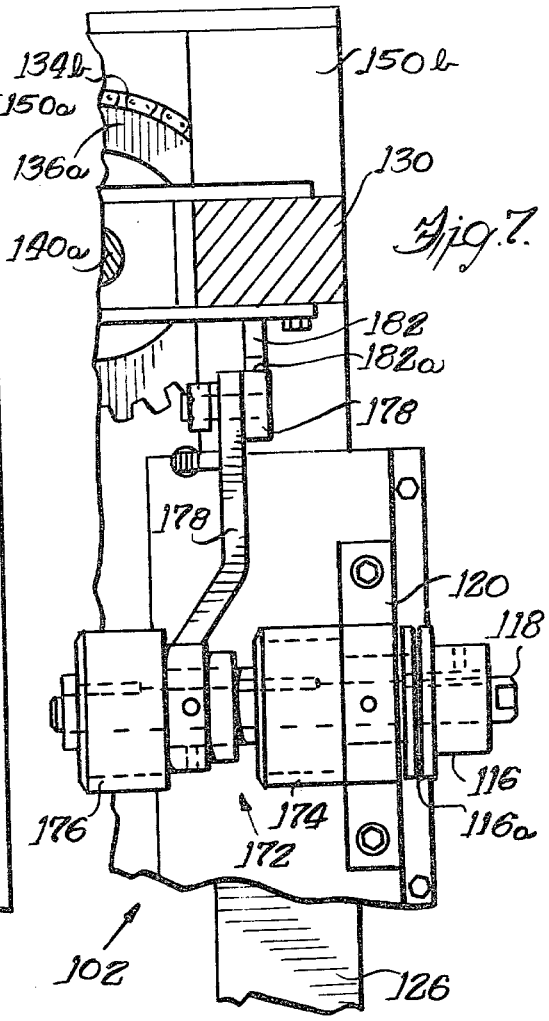
FIG. 7 is a fragmentary sectional view taken substantially along line 7—7 of FIG. 4, looking in the direction of the arrows.

To effect incremental longitudinal advance of the cutter wire filament 104 when the carriages 112 and 122 are in their upper positions with air pressure released from the air brake 156 associated with the supply spool 106, the take-up spool support shaft 118 has unidirectional drive means, indicated generally at 172, operatively associated therewith so as effect incremental rotation of the take-up spool 116 in a direction to draw the cutter filament from the supply spool. As best seen in FIG. 7, in the illustrated embodiment the unidirectional drive means 172 includes a first over-running clutch 174 which may be of the sprag type and is mounted on the shaft 118 and has operative association with the spool support block 120 so as to allow free rotation of the shaft 118 and take-up spool 116 in a clockwise direction, as considered in FIG. 4, while preventing counterclockwise rotation of the take-up spool.

The unidirectional drive means 172 includes a second over-running type clutch 176 which also may be of the sprag type and has an inner hub portion fixed on the shaft 118 and an outer drive member fixed to an actuating arm 178. The upper end of the actuating arm 178 carries a cam follower roller 180 adapted for engagement with the cam surface 182*a* on a control cam 182 mounted on the underside of the cross bar as the carriage 122 approaches its uppermost limit of travel following retraction from a cutting stroke. The unidirectional clutch 176 is such that the actuating arm 178 may freely rotate in a counterclockwise direction relative to the support shaft 118, as considered in FIG. 4, but when moved in a clockwise direction, as when the cam follower roller 180 engages the cam surface 182*a* and rides upwardly thereon, serves to effect rotation of the support shaft 118 and associated take-up spool 116 in a rotational direction to draw the elongate cutter wire filament 104 from the supply spool 106.

With the cutter wire filament 104 supported between the supply and take-up spools 106 and 116, respectively, as aforedescribed, it will be appreciated that when the carriages 112 and 122 are moved downwardly on their respective guide posts 126 and 128 through operation of the carriage indexing drive motor 146 and drive chains 134, the cutter filament will remain substantially fixed in length between the supply and take-up spools transverse to a block of bulk material disposed within the cutting station. The proximity switch 152*a* is positioned so as to be actuated to reverse the rotational direction of the carriage drive motor 146 when the carriages 112 and 122 reach their lower positions wherein the cutter filament 104 is disposed below the plane of the upper runs of the infeed chains 66, whereupon the carriages are returned to their uppermost positions. When the carriages reach their upper positions, the air valve actuator 164*a* is depressed to release the air brake 156. Simultaneously, the actuator arm 178 is rotationally advanced by the control cam 182 to incrementally rotationally advance the take-up spool 116 and thereby incrementally draw the cutter filament from the supply spool.

To assist in maintaining the block 20 of bulk material in relatively fixed position within the slab cutter station 18 during cutting of slabs therefrom, a clamping or block holder plate 186 having a plurality of downwardly extending pointed prongs 188 thereon is mounted on the lower end of an extendible piston 190 of a double acting pneumatic actuating cylinder 192 the upper end of which is suitably mounted on the cross bar 130 centrally of its length. A pair of stabilizing rods 194*a* and 194*b* are secured in normal relation to the upper surface of the clamping plate 186 and are received within tubular guide sleeves 196*a* and 196*b*, respectively, mounted on the cross bar 130 in parallel relation with the actuating cylinder 192. The actuating cylinder is connected to a suitable source of air pressure through a pneumatic control circuit (not shown) which includes a proximity switch 198 (FIG. 1) mounted on one of the arms 80. The proximity switch 198 has an actuator arm (not shown) disposed forwardly of the plane of the stop arms so as to sense engagement of the block 20 against the stop arms, whereupon the cylinder 192 is actuated to move the block holder plate 186 downwardly against the upper surface of the block and embed the prongs 188 therein. As the stop arms 80 are lowered to transfer a cut slab to the bar cutting station 28, the proximity switch 198 operates to retract the block holder plate and associated prongs 88 from the block of bulk material to allow forward indexing of the block preparatory to cutting the next slab therefrom.

As aforedescribed, the arm members 80 comprising the stop means 24 are pivotally movable between upright positions relative to the slab cutting station 18 and lowered positions during which the arm members transfer a slab cut from the block 20 to the bar cutter in-feed means 32. To stabilize the stop arm members 80 when disposed in their upper pivotal positions, locking bar means 202 are provided to releasibly engage the rearward upper tapered ends of the stop arm members. The locking bar means 202 includes a transverse locking bar 204 mounted on one end of a support frame 206 the opposite end of which is pivotally mounted on a cross frame 208 of generally inverted U-shape secured in upright relation on the main frame 12. The locking bar 204 and associated support frame 206 are movable through actuation of a double acting fluid pressure cylinder 210 between a first position wherein the locking bar engages the rearward upper surfaces of the arm members 80 and a second position freeing the support arms for downward pivotal movement. The cylinder 210 is mounted on a support bracket 212 secured to the cross frame 208 and is connected in a pneumatic control circuit (not shown) which includes a suitably positioned control or limit switch (not shown) operable to raise the locking bar 204 when a slab has been cut by the cutter filament 104 to enable lowering of the arms 80, and thereafter effect downward movement of the locking bar into locking relation with the arm members 80 after they are again raised to their upper pivotal positions.

In accordance with another important feature of the present invention, a cutter wire filament tension peg 216 is mounted on the lower end of the actuating cylinder 192 so as to lie in a transverse plane containing the path of travel of the filament 104. The filament tension peg 216 is positioned to engage the cutter filament 104 generally centrally of the reach thereof disposed between supply and take-up spools as the carriages 112 and 122 approach their upper limits on the guide posts 126, 128 after cutting each slab from a block of bulk material. The tension peg 216 is positioned downwardly from the upper cross bar 130 sufficiently to engage the cutter filament and prevent the center of the filament from moving upwardly the same distance as the ends thereof at the supply and take-up spools. This causes the cutter element to be slightly stretched as the support spools reach their upper limits so that when the take-up spool 116 is incrementally rotated by the actuating arm 178, the tension in the filament is sufficient to rotate the delivery spool to let-off a new incremental length of cutter filament.

It will be appreciated that when a length of cutter wire filament is passed through a block of bulk material such as cheese in a direction substantially transverse to the longitudinal axis of the filament, the cutter filament will "bow" sowewhat as it passes through the cheese and will not maintain a true linear configuration. There must be sufficient slack or "give" in the cutter filament to permit some amount of bowing in order to prevent unduly high tensile stress in the cutter filament which might result in tensile failure. The tension peg 216 serves to substantially duplicate the bowing configuration of the cutter filament when the filament is incrementally advanced while the support spools are in their uppermost positions so that after incremental advance of the cutter filament and initial downward movement of the carriages and associated spools 106 and 116, the cutter filament takes a configuration which permits desired bowing during cutting without unduly stressing the wire. It will be appreciated that the tension peg 216 could be supported by means other than the cylinder 192.

As aforementioned, after a slab is cut from a block of bulk material while positioned within the slab cutting station 18, the arm members 80 are operative to lower the cut slab to the bar cutter in-feed means 32 preparatory to cutting the slab into substantially uniform size bars within the bar cutting station 28. With particular reference to FIGS. 8–11, taken in conjunction with FIGS. 1, 2 and 12, the bar cutting in-feed means 32 and the bar cutter outfeed means 34 include common laterally spaced parallel frame members **220*a* and 220*b* which are suitably mounted on the base frame 12 in upwardly inclined relation thereon, considered in the direction of movement of a slab through the apparatus 10, as seen in FIG. 1. A plurality of endless conveyor belts 222 of the table top chain type of known design are supported in parallel spaced relation between the frame members 220*a, b* on associated pairs of aligned sprockets, such as indicated at 224*a*, 224*b* in FIG. 1, which are supported on transverse support shafts 226*a, b* suitably journalled to and between the frame members 220*a, b*. The conveyor belts or chains 222 are positioned so as to define upper runs which receive a cut slab thereon when the arm members 80 are pivoted to their downward positions transferring a slab onto the cutter bar in-feed means 32, it being understood that the conveyor belts 222 and associated support sprockets 224 are spaced apart sufficiently to receive the arms 80 therebetween when moved to their downward pivotal position. The conveyor belts 222 are selectively movable through a suitable electric drive motor 230 which, in the illustrated embodiment, is connected in driving relation with the forward sprockets 224*b* through a drive chain 232**.

The out-feed means 34 also includes a plurality of parallel conveyor belts or table top type chains 236 supported on pairs of sprockets, such as indicated at **238*a* and 238*b* in FIG. 1, fixed on support shafts 240*a* and 240*b*, which are suitably journalled between the frame members 220*a, b* in transverse relation thereto. The conveyor belts or chains 236 define upper runs substantially coplanar with the upper runs of the conveyor chains 222 so as to receive cut bars of product after passing a slab through the bar cutter die means 36. The conveyor belts or chains 236 are driven in synchronous relation with the drive chains 222 of the in-feed conveyor means 32 through an interconnecting drive chain 242 and associated sprockets mounted on the shafts 226*b* and 240*b*. as shown schematically in FIG. 12**.

Figure 11:
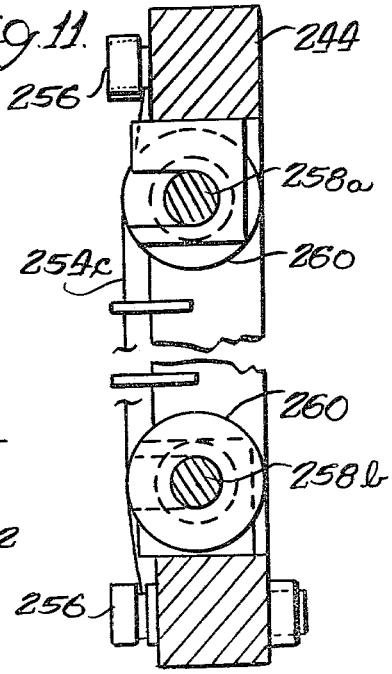
FIG. 11 is a transverse sectional view of the bar cutter die of FIG. 10, taken substantially along line 11—11 of FIG. 10.
Figure 10:
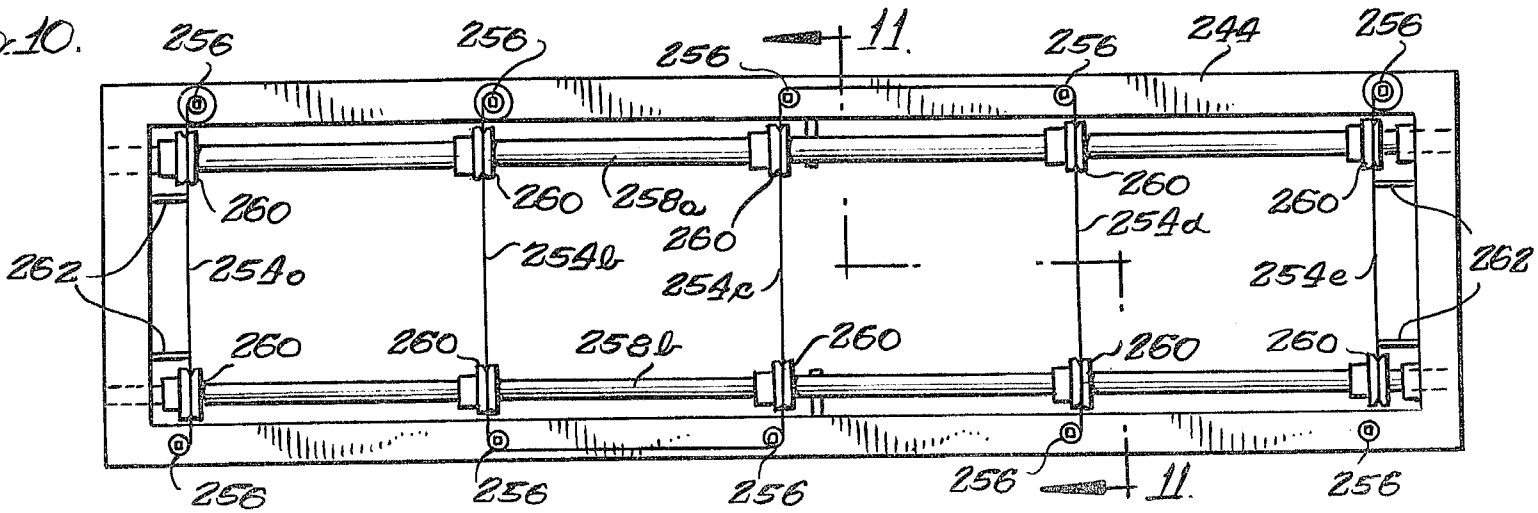
FIG. 10 is an elevational view of the bar cutter die of FIG. 9 but removed from its support frame.
Figure 12:
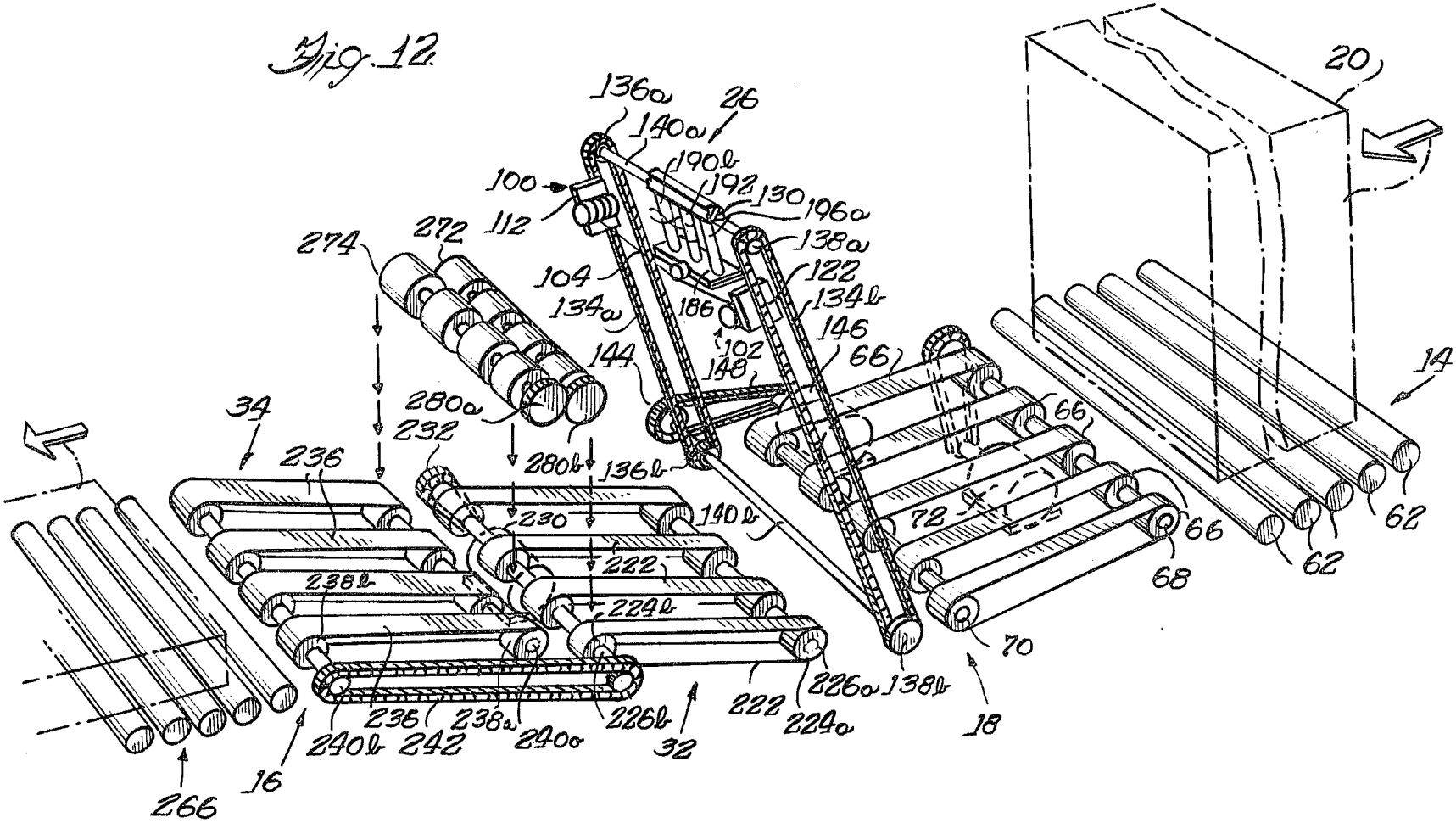
FIG. 12 is a schematic illustration of the various conveyor and drive means employed in the apparatus of FIG. 1.

The bar cutter die means 36 is disposed intermediate the conveyor sections defining the bar cutter in-feed means 32 and bar cutter out-feed means 34, and includes a rectangular cutter die frame 244 (FIGS. 10 and 11) adapted to be releasably received within transversely aligned open ended slots or grooves **246*a* and 246*b*, formed, respectively, in laterally opposed die holder members 248*a* and 248*b*, fixed to the inner surfaces of pressure feed end plates 250*a* and 250*b*. The die frame 244 supports a plurality of parallel equidistantly spaced cutter wire filaments 254*a–e* transversely thereof, as best seen in FIG. 10. The cutter filaments 254*a–e* may be formed from one or more lengths of a suitable wire filament, such as the aforementioned piano wire, which are secured transversely of the die frame by headed screws 256 such as socket head cap screws. Shafts 258*a* and 258*b* are mounted on the die frame 244 in parallel relation and support axially spaced wire alignment nuts 260 having annular grooves therein and which are aligned in pairs to engage and position the cutter wire filaments 254***a–e* slightly forwardly from the forward surface of the die frame, as illustrated in FIG. 11. Pairs of equal length spacer members 262 are secured to the opposite ends of the die frame 244 and extend laterally inwardly to engage the end cutter filaments 254*a* and 254*e* so as to prevent lateral distortion of and thereby provide stability for the end cutter filaments.

When assembled within the slots 246*a, b* between the pressure feed end plates 250*a, b*, the cutter die frame 244 is positioned so that a slab of the bulk material fed through the die frame is cut into bars of substantially uniform size by the cutter wire filaments 254*a–e*. The cut bars are then transferred by the out-feed conveyor means 34 for deposit on a discharge conveyor such as illustrated at 266 in FIGS. 1 and 12. Laterally spaced upstanding guide plates 268 are preferably mounted on the out-feed conveyor 34 to separate the outer trim pieces cut from the slab by the end cutter filaments 254*a* and 254*e*.

In accordance with an important feature of the present invention, the bar cutting station 28 includes pressure rollers 272 and 274 supported between the pressure feed end plates 250*a, b* so as to overlie the discharge end of the in-feed conveyor 222 and the input end of the out-feed conveyor 34, respectively, as best seen in FIG. 1. The pressure rollers 272 and 274 are mounted relative to the underlying in-feed and out-feed conveyors so that the rollers 272 can be adjusted to engage the upper surface of a slab being advanced through the cutter die frame 244 by the conveyor chains 222, while the pressure rollers 274 can be adjusted to engage the upper surfaces of cut bars to urge them into pressure contact with the upper runs of the conveyor chains 236 on the out-feed means 34.

Figure 8:
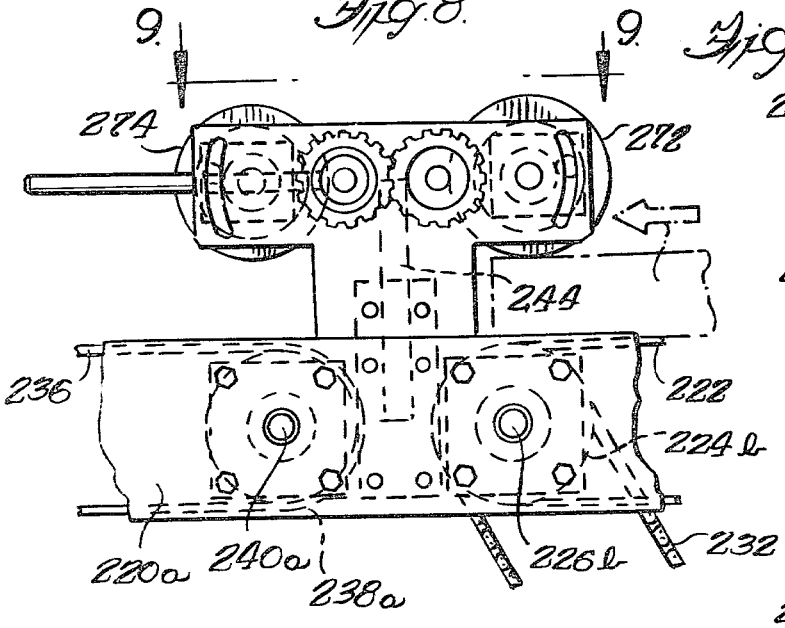
FIG. 8 is a fragmentary elevational view, on an enlarged scale, of the bar cutting station of FIG. 1.
Figure 9:
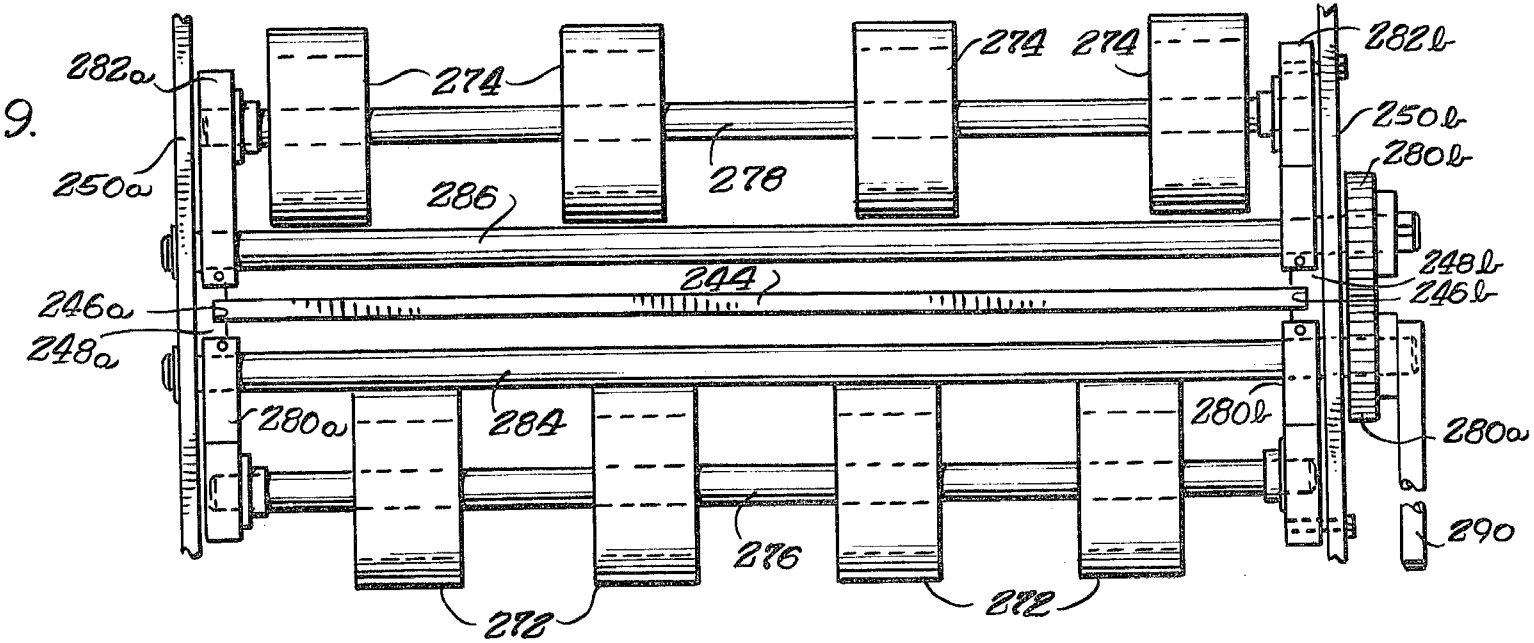
FIG. 9 is a fragmentary plan view, on an enlarged scale, of the bar cutting station of FIG. 8, taken substantially along line 9—9 of FIG. 8.

As best seen in FIGS. 8 and 9, the pressure rollers 272 and 274 each comprise a plurality of compression rollers mounted, respectively, in axially spaced relation on support shafts 276 and 278 journalled within pairs of support arms 280*a, b* and 282*a, b* fixed on pivot shafts 284 and 286 pivotally supported by and between the pressure end plates 250*a, b*. The pivot shafts 284 and 286 extend outwardly of one of the pressure feed end plates, such as 250*b*, and are interconnected through intermeshing spur gears 280*a* and 280*b* which are fixed on the pivot shafts. An actuating lever 290 is radially mounted on one of the pivot shafts, such as 284, and facilitates rotation of the pivot shafts 284, 286 to selectively vary the spatial relation of the pressure rollers 272 and 274 relative to their underlying conveyor chains 222 and 236, respectively. Suitable means are provided to releasibly lock the pressure rollers 272, 274 in adjusted position.

The pressure rollers 272 and 274 are adjusted, respectively, to apply sufficient pressure against the upper surface of a slab passing beneath the rollers 272 and against the upper surfaces of cut bars exiting from the cutter die holder frame 244 so as to effect positive uniform forward feeding of the slab through the cutter die frame without distorting the slab. This has been found to be particularly advantageous in obtaining cut bars of uniform size and shape through elimination of distortion and "ballooning" of the slab as it passes through the cutter die frame, as has been experienced with prior art procedures which push the slab from its rearward end surface through cutter filaments to slice or cut the slab into bars.

Briefly reviewing the operation of the apparatus 10 in accordance with the aforedescribed embodiment, a block of bulk material, such as block 20 of cheese, is transferred onto the conveyor rollers 62 of the slab cutting station 18 whereafter the block moves downwardly by gravity onto the driven in-feed conveyor chains 66 until its forward surface engages the stop arms 80 which are disposed in upstanding relation relative to the slab cutting station and are held firmly by the locking bar 204. Engagement of the block against the raised stop arms 80 stops motor 72 through said control means (not shown) and actuates the proximity switch 198 to actuate cylinder 192 and lower the block holder plate 186 into engagement with the block 20 adjacent but rearwardly of the portion which will be slabbed from the block. It will be appreciated that the slab cutting station 18 has previously been adjusted relative to the upstanding stop arms 80 so as to establish a predetermined thickness of slabs to be cut by the slab cutter means 26.

With the block of bulk material in proper position within the slab cutting station 18, the carriage drive chain motor 146 is energized to simultaneously move the carriages 112 and 122 downwardly to pass the cutter wire filament 104 through the block of bulk material in transverse relation thereto so as to cut a slab from the block. When the cutter wire has completed a cut, the proximity switch 152*a* is actuated to reverse the drive motor 146 and return the cutter wire filament and associated supply and take-up spools 106 and 116 to their upper positions at which time the cutter wire filament is incrementally advanced from the supply to the take-up spool while the filament is tensioned by engaging the center thereof with tensioning means in the form of the tension peg 216 as aforedescribed. Movement of the carriage drive chains to return the carriages to their upper positions operates to actuate the proximity switch 152*b* to deenergize motor 146 and condition it for the next downward movement of the cutter wire filament.

After a slab is cut from the block of bulk material, the locking bar 206 is pivoted upwardly free of the stop arms 80 which are then pivoted downwardly through actuation of the actuating cylinder 84 to transfer the cut slab onto the in-feed conveyor belts 222 of the bar cutting station 28. The conveyor drive motor 230 is then energized to advance the slab into pressure engagement by the pressure rollers 272 which cooperate with the in-feed conveyor belts 222 to move the slab through the cutter die frame 244 and effect cutting of the slab into bars of uniform size. After the slab leaves the bar cutter in-feed conveyor belts 222, the stop arms 80 are returned to their upper positions at which time the cutter station conveyor drive motor 72 is energized to index the block of bulk material against the stop arms to initiate another slab cutting cycle.

In the illustrated embodiment, the cutter die frame 244 is operative to cut the slab into four bars of uniform size. It will be appreciated that the cutter die frame 244 may be interchanged with other cutter die frames adapted to cut the slabs into bars of different desired size.

The bars exiting from the cutter bar frame 244 are engaged on their upper surfaces by the pressure rollers 274 which urge the cut bars against the out-feed conveyor chains 236 and thereby assist the pressure roller 272 and in-feed conveyor belts 222 in passing the slab through the cutter die frame. Thereafter, the cut bars may be transferred onto the discharge conveyor 266 for further processing or cutting as desired. Suitable controller means (not shown) of conventional design may be employed to effect predetermined sequencing of the various operating functions of the apparatus 10 and will not be described in detail herein.

Thus, in accordance with the present invention, it is seen that a method of cutting a block of bulk material into transverse slabs is provided wherein an elongate cutter filament is supported transverse of the block and is moved through the block in a direction transverse to the cutting length of the cutter filament so as to cut a slab from the block, whereafter the cutter filament is incrementally axially advanced so as to progressively remove any given segment thereof from the effective cutting length of the filament before such segment fatigues to possible failure. The method of the invention also preferably includes prestressing of the elongate cutter filament after each pass and during incremental advance from the supply to the take-up spools disposed on laterally opposite sides of the block of bulk material so that any elongation or slight stretching of the cutter filament that may take place during cutting of slabs from the block is duplicated during incremental advance to insure let-off from the supply spool. This prestressing also substantially duplicates during advance of the cutter filament the "bowed" condition of the cutter filament assumed as it cuts a slab from the block so that the cutter filament begins each cut under substantially the same tension throughout extended production runs, thereby adding to the accuracy filament travel through the block.

The method of the invention also contemplates passing a cut slab through a bar cutter die to cut the slab into two or more smaller size bars by applying driving pressure against opposite surfaces of the slab closely adjacent the die cutter sufficient to move the slab through the cutter die while not pressurizing the remaining uncut portion of the slab. As the cut bars emerge from the cutter die means, the bars are subjected to second pressurized drive means acting on their opposite upper and lower surfaces closely adjacent the exit side of the cutter die so as to assist in drawing the slab through the cutter die means. This minimizes the internal pressure within the slab as it passes through the cutter die, with the result that distortion of the slab, frequently termed "ballooning," is virtually eliminated and substantially planar parallel cuts are made by the cutter filaments.

While a preferred embodiment of the method and apparatus of the present invention has been illustrated and described, it will be understood that changes and modifications may be made therein without departing from the invention in its broader aspects.

Various features of the invention are defined in the following claims.

What is claimed is:

1. Cutter apparatus for cutting a block of bulk material into smaller size slabs, said apparatus comprising, in combination;

means adapted to maintain a block of bulk material in position for cutting slabs therefrom, an elongate cutter filament, means supporting said cutter filament so as to define a reach thereof disposed substantially transverse to said block and spaced therefrom, means cooperative with said support means and adapted to effect movement thereof so as to pass said reach of cutter filament through said block in a direction transverse to said reach of cutter filament and cut a slab from said block, and means cooperative with said support means and adapted to axially advance said cutter filament after each pass through said block.

2. Cutter means as defined in claim 1 wherein said last mentioned means is adapted to incrementally axially advance said cutter filament after each successive pass through said block so as to progressively remove any given segment of said filament from the effective cutting length thereof before said given segment becomes fatigued to possible failure.

3. Cutter apparatus as defined in claim 1 including means defining a stop surface adapted for abutment with said block to define a cutting position for said block, and means adapted to index said block against said stop surface after a slab is cut therefrom.

4. Cutter apparatus as defined in claim 1 wherein said means supporting said cutter filament includes supply spool means and take-up spool means adapted to support said cutter filament in wound relation thereon.

5. Cutter apparatus as defined in claim 4 wherein said means cooperative with said support means for effecting movement thereof to pass said filament through said block includes carriage means cooperative with each of said supply and take-up spool means, said means cooperative with said support means for axially advancing said cutter filament including first means supporting said supply spool means on its associated carriage means in a manner to enable let-off of said cutter filament therefrom, and second means supporting said take-up spool means on its associated carriage means in a manner to enable takeup of said filament so as to draw said filament from said supply spool means.

6. Cutter apparatus as defined in claim 5 wherein said means cooperative with said support means for effecting movement thereof to pass said filament through said block further includes means for guiding and moving said carriages from first positions preparatory to cutting a slab from said block to second positions upon completion of cutting a slab from said block, said first means including clutch means cooperative with said supply spool means to enable drawing of said filament therefrom only when said carriages are in their said first positions.

7. Cutter apparatus as defined in claim 6 wherein said clutch means comprises a fluid pressure operated clutch.

8. Cutter apparatus as defined in claim 6 including friction brake means cooperative with said supply spool means and adapted to restrict movement of said supply spool means when enabled by said clutch means for drawing said cutter filament therefrom.

9. Cutter apparatus as defined in claim 6 wherein said second means includes unidirectional drive means cooperative with said take-up spool means to draw said filament from said supply spool means only when said carriages are in their said first positions.

10. Cutter apparatus as defined in claim 9 including cam means cooperative with said unidirectional drive means and adapted to effect movement of said take-up spool means to draw said cutter filament from said supply spool means as said carriages are returned to their said first positions from said second positions.

11. Cutter apparatus as defined in claim 1 wherein said first mentioned means comprises a slab cutting station adapted to receive a block of bulk material therein preparatory to cutting slabs therefrom.

12. Cutter apparatus as defined in either of claims 2 or 4 including tensioning means adapted to act on said elongate cutter filament and place it in axial tension as it is advanced after each cut.

13. In apparatus for sequentially cutting a block of bulk material, which apparatus includes means defining a slab cutting station, means for positioning a blck of bulk material in predetermined relation to said slab cutting station, and slab cutter means disposed at said slab cutting station and adapted to sequentially cut said block into slabs of predetermined size while said block is disposed in said slab cutting station; the improvement wherein said slab cutter means includes cutter filament supply means adapted to support a length of elongate cutter filament, filament take-up means adapted to receive elongate cutter filament from said supply means, a substantially non-elastic elongate filament supported by said supply and take-up means so as to define a reach of filament disposed between said supply and take-up means, means supporting said supply and take-up means in position to establish said reach of cutter filament transverse to said block of bulk material when disposed in said predetermined relation to said slab cutting station, said support means being operative to move at least one of said supply and take-up means in a direction to effect passage of said reach of cutter filament through said bulk material so as to cut a slab therefrom, and means operatively associated with said supply and take-up means to longitudinally advance said cutter filament from said supply means to said take-up means after cutting a slab from said block.

14. Apparatus as defined in claim 13 wherein said advancement means includes means to progressively remove at least a portion of said cutter filament from the effective cutting length thereof after a slab has been cut from said block.

15. Apparatus as defined in claim 14 wherein said filament supply and take-up means each includes a selectively rotatable spool.

16. Apparatus as defined in claim 15 wherein said filament take-up means further includes unidirectional drive means cooperative with said take-up spool to effect rotation thereof in a direction to draw said filament from said supply spool after each slab has been cut from said block, said unidirectional drive means being operative to prevent rotation of said take-up spool in an opposite rotational direction.

17. Apparatus as defined in claim 16 wherein said filament supply means includes brake means operatively associated with said supply spool and selectively operable to prevent movement thereof except when said take-up spool is rotated in a direction to draw said cutter filament from said supply spool.

18. Apparatus as defined in claim 15 wherein said support means includes a pair of carriages each of which supports one of said supply and take-up spools, and drive means for effecting simultaneous coordinated movement of said carriages between first and second positions so as to effect movement of said cutter filament through said block in a direction substantially normal to the effective cutting length of said filament, said means for advancing said filament including cam operated means adapted to rotate said take-up spool to draw said cutter filament from said supply spool only when said carriages are in a selected one of said first and second positions.

19. Apparatus as defined in claim 13 and further including a slab cutting station, and means for transferring a slab cut from said block to said slab cutting station, said slab cutting station including means for effecting movement of said slab in a predetermined direction, cutter die means defining a plurality of cutter filaments positioned in the path of movement of said slab and adapted to cut said slab into a plurality of smaller size bars when said slab is passed through said cutter die means, and first pressure drive means disposed closely adjacent an input side of said cutter die means and adapted to engage opposite surfaces of said slab so as to power said slab through said cutter die means.

20. Apparatus as defined in claim 19 wherein said slab cutting station includes second pressure drive means disposed closely adjacent an exit side of said cutter die means and adapted to engage opposite surfaces of cut bars emerging from said cutter die means in a manner to assist in passing said slab through said cutter die means.

21. Apparatus as defined in claim 20 wherein said first pressure drive means includes in-feed conveyor means adapted to receive a slab thereon and move the slab in said predetermined direction, and pressure roller means closely adjacent said cutter die means and operative to engage a slab on said in-feed conveyor means and urge the slab against said in-feed conveyor means so as to power the slab through said cutter die means.

22. Apparatus as defined in claim 21 wherein said second pressure drive means includes out-feed conveyor means adapted to receive cut bars thereon from said cutter die means, and pressure roller means closely adjacent the exit side of said cutter die means and operative to engage bars emerging from said cutter die means and urge said bars into pressure contact with said out-feed conveyor means.

23. Apparatus as defined in claim 22 including means supporting said pressure roller means for selective adjustment relative to said in-feed and out-feed conveyor means so as to enable varying of the pressure applied by said pressure rollers on said slab and cut bars.

24. In apparatus for simultaneously cutting a slab of bulk material into a plurality of smaller size bars, which apparatus includes means defining a bar cutting station adapted to receive a slab of bulk material in predetermined relation therein, bar cutting die means disposed within said bar cutting station and defining a plurality of cutter filaments adapted to simultaneously cut a slab into bars of predetermined size when said slab is moved through said bar cutting station; the improvement wherein said bar cutting station includes first conveyor means adapted to receive a slab thereon and move the slab in a direction through said bar cutting die means, pressure roller means disposed closely adjacent said bar cutting die means and spaced from said first conveyor means so as to engage a slab thereon in pressure contact therewith to power feed said slab through said bar cutting die means.

25. Apparatus as defined in claim 24 wherein said pressure roller means is adjustably mounted upon a roller frame for selective adjustment relative to said first conveyor means.

26. Apparatus as defined in claim 24 including second conveyor means disposed adjacent to exit side of said bar cutting die means and adapted to receive cut bars emerging from said die means, and second pressure roller means disposed closely adjacent the exit side of said bar cutting die means and adapted to engage cut bars emerging from said die means so as to urge said bars against second conveyor means in pressure contact therewith, whereby as a slab is propelled through said cutter die means, emerging bars are engaged between said second conveyor means and said second pressure roller means and drawn through said bar cutting die.

27. A method of cutting a block of bulk material into smaller size slabs, said material being capable of having an elongate cutter filament passed therethrough in a direction generally transverse to the cutter filament, said method comprising the steps of;

positioning an elongate cutter filament transversely of a block of bulk material, moving said cutter filament through said block in a direction substantially transverse to said filament so as to cut a slab from said block, said incrementally axially advancing said cutter filament after each pass through said block so as to progressively remove any given segment of the filament from the effective cutting length before said given segment fatigues to possible failure.

28. The method as defined in claim 27 wherein said cutter filament comprises an elongate wire filament supported on supply and take-up spools, disposed on laterally opposite sides of the block, said step of incrementally advancing said filament from said supply to said take-up spools.

29. The method as defined in claim 27 including the step of pre-tensioning said filament during axial advancing thereof after each pass through said block.

30. A method of cutting a slab of bulk material into smaller size bars, said slab having opposite generally planar side surfaces and a forward edge surface, said method comprising the steps of;

positioning the slab adjacent a cutting die defining at least one elongate cutter filament so that said filament is disposed generally parallel to said forward edge surface and substantially transverse to the slab;

and passing said slab through said cutter die so that said cutter filament cuts said slab into at least two smaller size bars, passing of said slab through said cutter die being effected by engaging opposite side surfaces of said slab with first pressure drive means applied closely adjacent said cutting die so that the uncut portion of the slab spaced from said pressure drive means is in a non-pressurized condition.

31. The method as defined in claim 30 wherein said cutter die includes a plurality of cutter filaments adapted to cut said slab into a plurality of bars of substantially uniform size.

32. The method as defined in claim 30 including the step of engaging opposite surfaces of the cut bars with second pressure drive means as they exit from said cutter die so as to assist in passing the slab through said cutter die.

33. The method as defined in claim 30 wherein said first pressure drive means includes driven conveyor means adapted to support said slab thereon, and pressure roller means engaging said slab closely adjacent said cutter die so as to urge said slab against said driven conveyor means.

34. The method of claim 33 including the step of engaging opposite surfaces of the cut bars with second pressure drive means as they exit from said cutter die so as to assist in passing the slab through said cutter die, said second pressure drive means including second driven conveyor means adapted to support said cut slabs as they exit from said cutter die, and pressure roller means engaging said cut bars on the exit side of said cutter die so as to urge said cut bars against said second driven conveyor means.

* * * * *

UNITED STATES PATENT AND TRADEMARK OFFICE

CERTIFICATE OF CORRECTION

PATENT NO. : 4,208,931

DATED : June 24, 1980

INVENTOR(S) : Truman F. Collins

It is certified that error appears in the above-identified patent and that said Letters Patent are hereby corrected as shown below:

Column 3, line 33, "is" should be --in--.

Column 3, line 40, "meams" should be --means--.

Column 15, line 7, "blck" should be --block--.

Column 16, line 67, insert "said" after --against--.

Column 17, line 14, "said" (first occurence) should be --and--.

Signed and Sealed this

*Twenty-first* Day of *October 1980*

[SEAL]

*Attest:*

SIDNEY A. DIAMOND

*Attesting Officer*

*Commissioner of Patents and Trademarks*